US006606949B1

(12) United States Patent
Funabashi

(10) Patent No.: US 6,606,949 B1
(45) Date of Patent: Aug. 19, 2003

(54) SHEET-FED ROTARY PRINTING PRESS

(75) Inventor: Isao Funabashi, Ibaragi (JP)

(73) Assignee: Komori Corporation (JP)

( * ) Notice: Subject to any disclaimer, the term of this patent is extended or adjusted under 35 U.S.C. 154(b) by 0 days.

(21) Appl. No.: 09/662,557

(22) Filed: Sep. 15, 2000

(30) Foreign Application Priority Data

Sep. 16, 1999 (JP) ..... 11-262232

(51) Int. Cl.[7] ..... B41F 31/00
(52) U.S. Cl. ..... 101/491; 101/494; 101/232
(58) Field of Search ..... 101/491, 494, 101/132, 232, 233

(56) References Cited

U.S. PATENT DOCUMENTS

| | | | | |
|---|---|---|---|---|
| 3,949,670 A | | 4/1976 | Katsuji | 101/177 |
| 3,970,393 A | * | 7/1976 | Krygeris et al. | 356/195 |
| 4,428,287 A | * | 1/1984 | Greiner | 101/170 |
| 4,639,881 A | | 1/1987 | Zingher | |
| 4,768,746 A | | 9/1988 | Rodi et al. | |
| 5,029,525 A | | 7/1991 | Jeschke | |
| 5,377,587 A | * | 1/1995 | Kobler | 101/233 |
| 6,343,548 B1 | * | 2/2002 | Bayer et al. | 101/132 |

FOREIGN PATENT DOCUMENTS

| | | |
|---|---|---|
| DE | 2727426 | 6/1977 |
| DE | 2728738 | 6/1977 |
| DE | 3220622 | 1/1982 |
| DE | 299 04 511 U1 | 3/1999 |
| EP | 021349 | 5/1986 |
| EP | 0236775 | 2/1987 |
| EP | 0 527 407 A1 | 8/1992 |
| EP | 0753409 | 7/1995 |
| EP | 0 863 002 A1 | 2/1998 |
| EP | 00120042 | 1/2001 |
| JP | 58-45965 | 3/1983 |
| JP | U1-36611 | 11/1989 |
| JP | 6-023960 | 2/1994 |
| WO | WO 97/48556 | 6/1996 |

OTHER PUBLICATIONS

Blair, Ray, Editor in Chief, Destree, Thomas M, Editor, "The Lithographers Manual", Eighth Edition, The Graphic Arts Technical Foundation, Inc., Pittsburgh, Pennsylvania, 1988.

* cited by examiner

*Primary Examiner*—Charles H. Nolan, Jr.
*Assistant Examiner*—Andrew H. Hirshfeld
(74) *Attorney, Agent, or Firm*—Blakely, Sokoloff, Taylor & Zafman

(57) ABSTRACT

A sheet-fed rotary printing press includes a feed unit, a printing unit, a delivery unit, and a printing quality control unit. The feed unit feeds sheet-like objects one by one. The printing unit performs printing on the sheet-like objects supplied from the feed unit. The delivery unit delivers the sheet-like objects printed by the printing unit. The printing quality control unit is provided on the delivery unit to adjust an amount of ink to be used for printing on the sheet-like objects.

7 Claims, 3 Drawing Sheets

SHEET-FED ROTARY PRINTING PRESS

BACKGROUND OF THE INVENTION

The present invention relates to a sheet-fed rotary printing press having an ink amount adjusting unit for adjusting the amount of ink in a printing unit by comparing printed paper with a printed sample.

Generally, in a sheet-fed rotary printing press of this type, test printing is performed based on a printed sample prior to final printing in order to adjust the inking amount of each color and the like. As a sheet-fed rotary printing press having such an inking amount adjusting unit for adjusting the inking amount, one disclosed in Japanese Utility Model Publication No. 1-36611 is available. The sheet-fed rotary printing press disclosed in this reference has a control panel for adjusting the inking amount by moving ink blades divided in units of sections by remote control. This control panel has, on its surface, a display for displaying the inking amounts of the inking units of the printing press in units of sections, and an operation unit provided with pushbuttons for operating the inking units and the like. In this arrangement, a printed sheet is extracted from a delivery unit every predetermined number of sheets, and the pushbuttons of the operation unit of the control panel are operated while comparing the printed sheet with the printed sample, thereby adjusting the inking amount.

In the conventional sheet-fed rotary printing press described above, since the control panel is provided independently of the printing press main body, the space where the control panel is to be installed is needed in addition to that for the printing press main body to fail a reduction in manufacturing cost. Since the control panel is installed separately from the printing press main body, the operator must make a round trip between a delivery unit and control panel of the printing press, leading to poor workability. Also, the wiring cable for connecting the printing press main body and control panel interferes with the operation.

SUMMARY OF THE INVENTION

It is an object of the present invention to provide a sheet-fed rotary printing press which does not require an independent control panel so that the manufacturing cost is reduced.

It is another object of the present invention to provide a sheet-fed rotary printing press in which the workability is improved.

In order to achieve the above objects, according to the present invention, there is provided a sheet-fed rotary printing press comprising a feed unit for feeding sheet-like objects one by one, a printing unit for printing on the sheet-like objects supplied from the feed unit, a delivery unit for delivering the sheet-like objects printed by the printing unit, and an ink amount adjusting unit provided on the delivery unit to adjust an amount of ink to be used for printing on the sheet-like objects.

DESCRIPTION OF THE PREFERRED EMBODIMENTS

The present invention will be described in detail with reference to the accompanying drawings.

Figure 1:
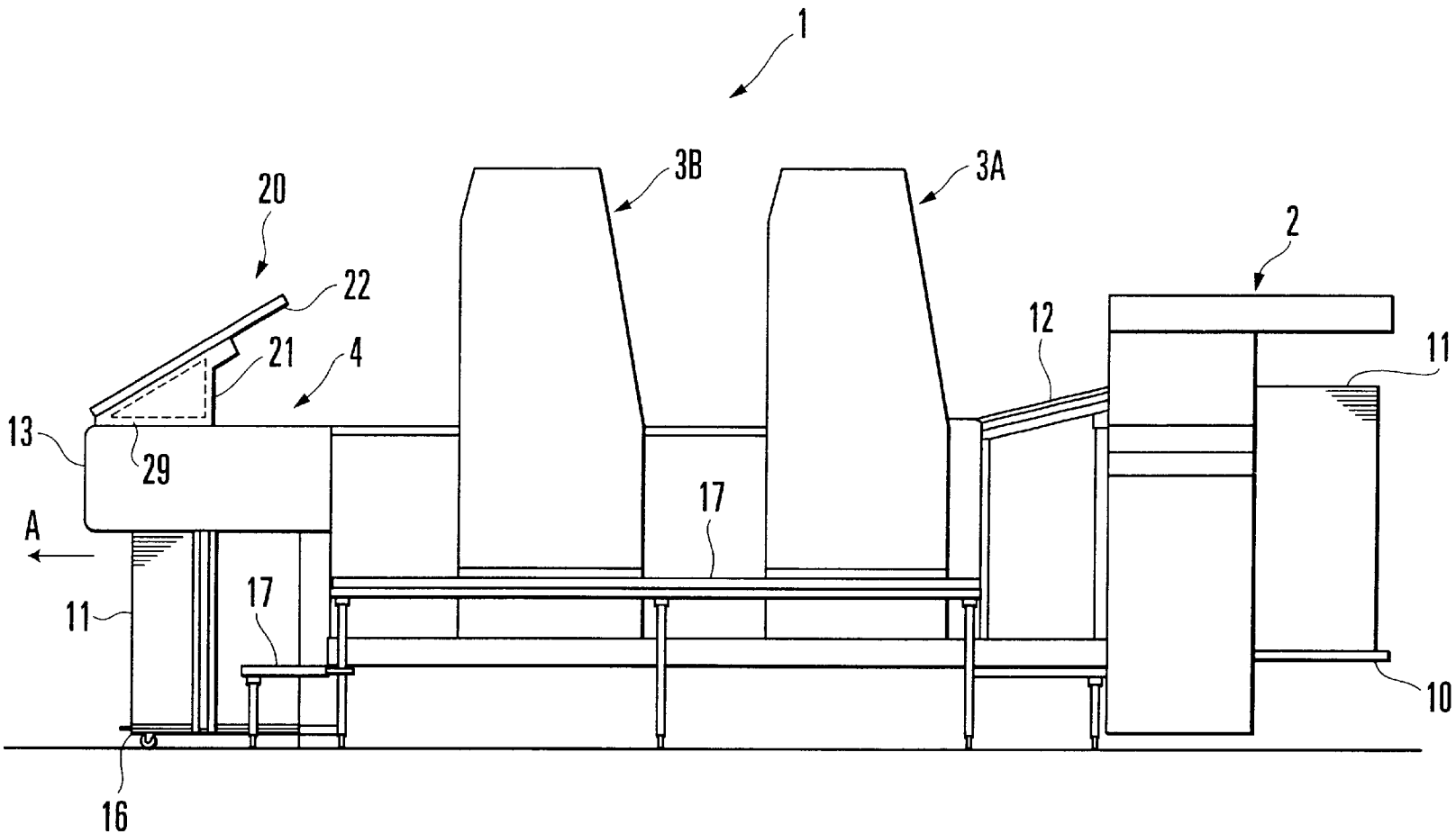
FIG. 1 is a side view schematically showing a sheet-fed rotary printing press according to an embodiment of the present invention.

FIG. 1, shows a whole sheet-fed rotary printing press according to an embodiment of the present invention. Referring to FIG. 1 a sheet fed rotary printing press 1 is schematically comprised of a feed unit 2 for feeding sheets 11 as sheet-like objects stacked on a pile board 10 one by one at a predetermined interval, printing units 3A and 3B for sequentially printing on the sheets 11 supplied from the feed unit 2 in units of colors, and a delivery unit 4 for delivering the printed sheets supplied from the printing unit 3B. As used herein, "sheet-like objects" refers to sheet materials, such as sheets of paper or other print medium that can be formed into printed materials.

The feed unit 2 draws by suction the sheets 11 stacked on the pile board 10 with a sucker unit (not shown) one by one, and feeds them onto a feedboard 12. The sheet 11 supplied from the feed unit 2 is gripped by the grippers of the impression cylinder of the first-color printing unit 3A with a swing unit (not shown), and is printed in the first color. The sheet 11 printed in the first color is transferred to the grippers of the impression cylinder of the second-color printing unit 3B through a transfer cylinder, and is printed in the second color. The sheet 11 printed in the second color is conveyed to the delivery unit 4 with a method to be described later. A printing quality control unit 20 is provided above the delivery unit 4 to store a controller 29 and to control the printing quality by adjusting the amount and the like of ink to be printed on the sheet 11.

Figure 2A:
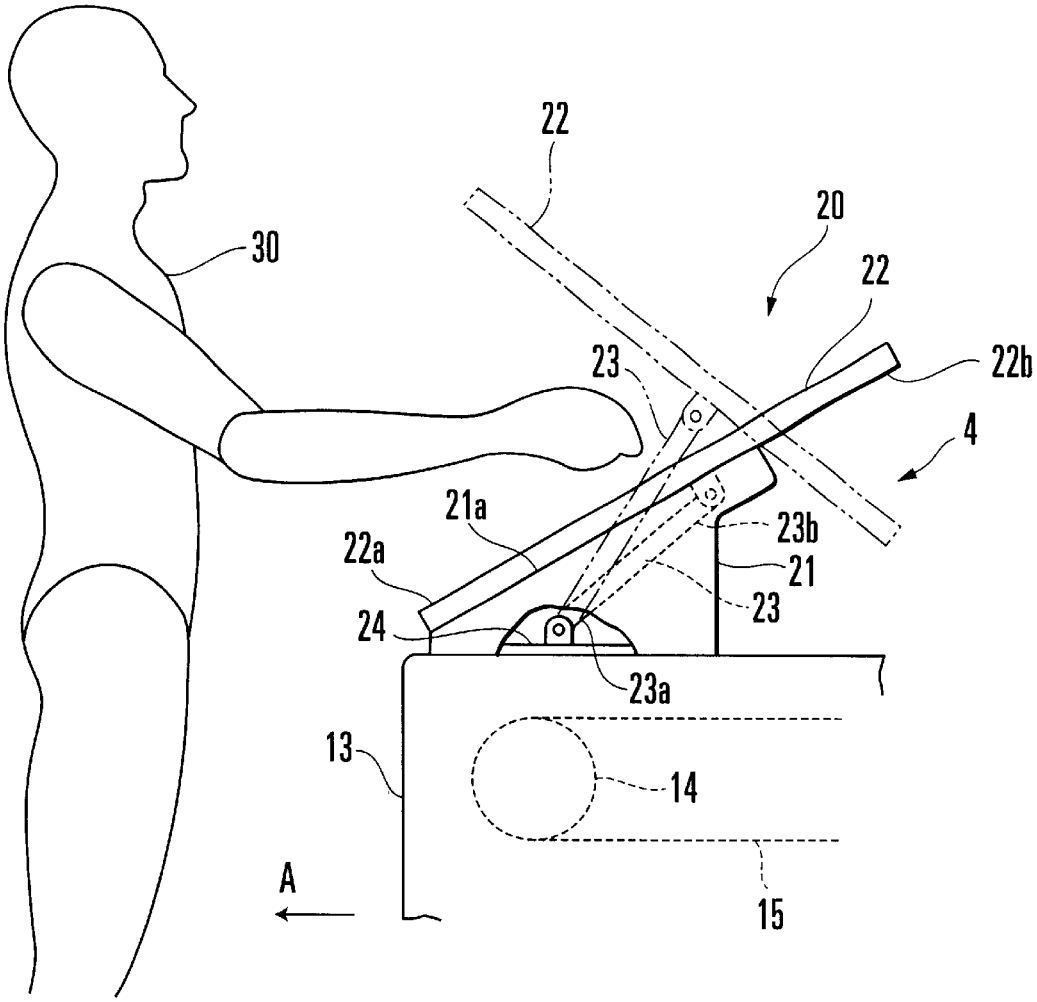
FIG. 2A is a side view of the delivery unit shown in FIG. 1.

Referring to FIG. 2A, a pair of sprockets 14 are provided at the front end sides of a pair of delivery frames 13 of the delivery unit 4. Another pair of sprockets (not shown) are provided at the rear end side of the delivery frames 13. A pair of delivery chains 15 extend between the front and rear sprockets, and a plurality of sets of gripper bars (not shown) having paper gripper units are supported between the delivery chains 15 at predetermined pitches.

The sheet 11 printed by the second-color printing unit 3B and transferred to the paper gripping nits is conveyed by the delivery chains 15, released from the paper gripper units by a cam mechanism (not shown), and dropped and stacked on a pile board 16 provided below the terminal end of the convey path. The sheet 11 stacked on the pile board 16 is extracted by an operator 30 in a direction of arrow A, i.e., to the front side (downstream of the convey direction) of the pile board 16.

A step 17 in FIG. 1 serves as a footing for the operator during plate exchange and maintenance and inspection of the inking units and the like. The arrangements of the respective portions of the sheet-fed rotary printing press described above are not particularly different from those of the conventional widely known sheet-fed rotary printing press, and the contents of U.S. Pat. No. 3,949,670 are incorporated herein by reference.

Figure 2B:
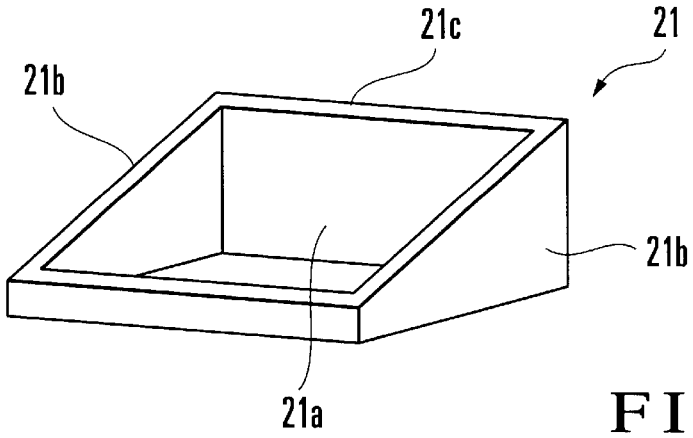
FIG. 2B is a perspective view of the case portion of the printing quality control unit shown in FIG. 2A.

As shown in FIG. 2A, the printing quality control unit 20 is comprised of a case 21 fixed to the upper portions of the delivery frames 13 and having an opening 21*a* in its upper surface, an operation panel 22 openably supported by the case 21 to cover the opening 21*a*, and the controller 29 (FIG. 1) (described above) made up from a control board and the like packaged in the case 21. The operation panel 22 is longer than the opening 21*a* in the front-to-rear direction. As shown in FIG. 2B, the case 21 is comprised of a pair of opposing right-angled triangular side frames 21*b*, and a rectangular rear frame 21*c* connecting the rear ends of the side frames 21*b* to each other, and has a shape obtained by incliningly cutting a substantially rectangular cylinder such that its rear portion is higher than its front portion.

The controller 29 packaged in the case 21 controls the inking devices, dampening unit, registration unit, and the like in the sheet-fed rotary printing press 1 through the operation of the touch panel of a display 25 (to be described later) and the pushbuttons of operation units 26*a* and 26*b*. The opening 21*a* of the case 21 is inclined such that its height increases from the front side toward the rear side. The operation panel 22 is also supported in the inclined manner such that its height increases from the front side toward the rear side to correspond to the opening 21*a*.

This arrangement will be described in detail. The operation panel 22 is pivotally supported at its two ends by a pair of extendable studs 23 so as to open/close the opening 21*a* of the case 21. Lower ends 23*a* of the studs 23 are pivotally supported by a bottom 24 of the case 21 (the upper portions of the delivery frames 13), and upper ends 23*b* thereof are pivotally connected to the operation panel 22. The lower ends 23*a* of the studs 23 are supported near substantially the center of the case 21, and the upper ends 23*b* thereof are connected to the operation panel 22 near substantially the center of the operation panel 22.

Hence, when the operation panel 22 is closed, a front end 22*a* of the operation panel 22 coincides with the front edge of the opening 21*a*, and a rear end 22*b* of the operation panel 22 projects larger than the rear edge of the opening 21*a* to cover the opening 21*a*. When the operation panel 22 is opened, the operation panel 22 pivots in the opening direction about the rear edge of the opening 21*a* (the upper rear end of the case 21) as the fulcrum. At this time, the studs 23 extend in response to the opening operation of the operation panel 22.

Figure 3:
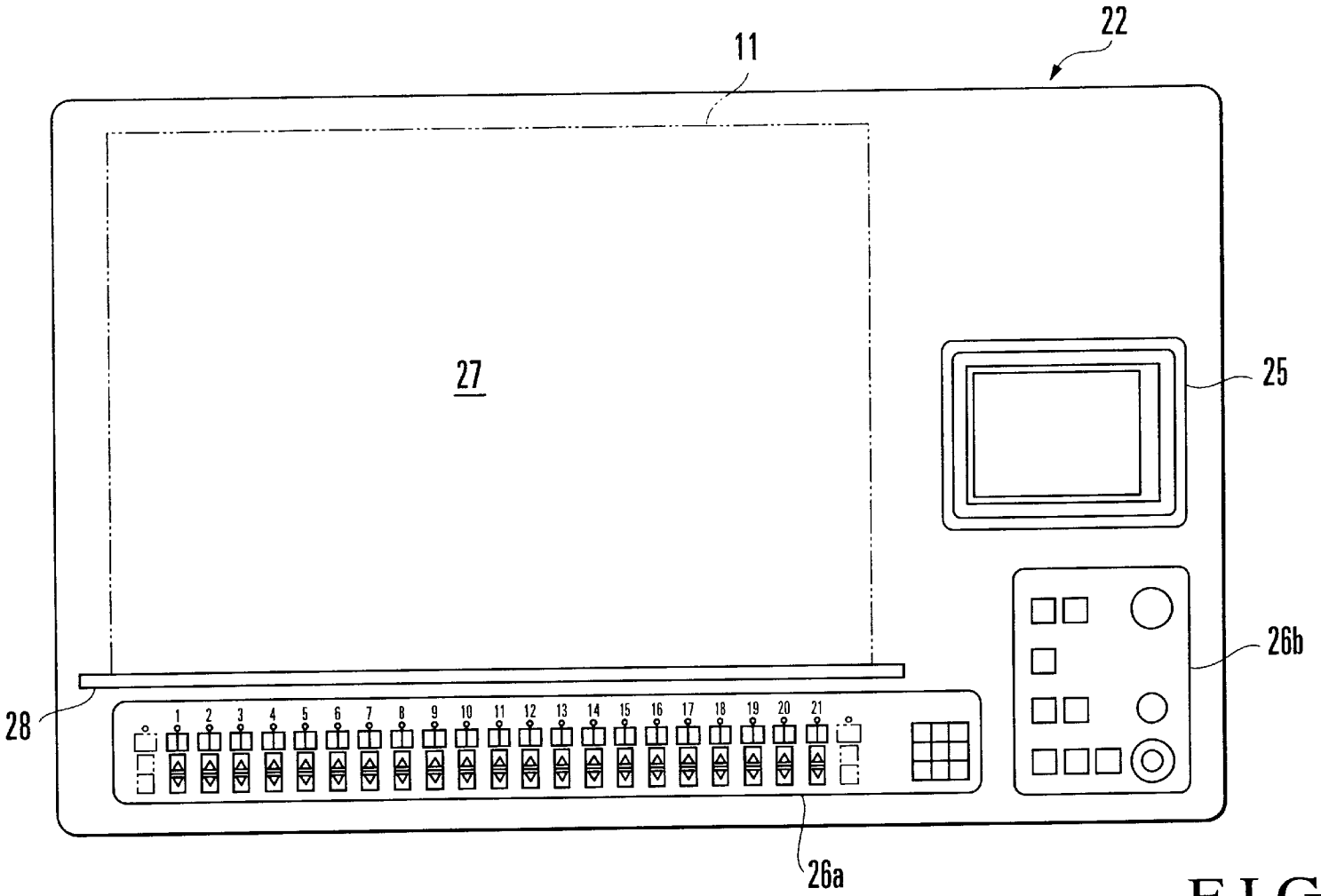
FIG. 3 is a plan view of the operation panel shown in FIG. 2A.

As shown in FIG. 3, the operation panel 22 incorporates the touch panel-type display 25 for controlling the inking devices, and the operation units 26*a* and 26*b* having the pushbuttons for starting the inking devices, the dampening unit, the registration unit, and the like. The region of the operation panel 22 excluding the display 25 and operation units 26*a* and 26*b* is used as a printed product checking table 27 on which the sheet 11 printed by the sheet-fed rotary printing press 1 is to be stacked. A bar 28 is formed along the lower side of the printed product checking table 27 to regulate the printed sheet 11 from slipping down.

The control operation of the inking devices, dampening unit, and registration unit of the sheet-fed rotary printing press having the above arrangement will be described.

When the sheet-fed rotary printing press 1 starts test printing, as shown in FIG. 2A, the operator 30 standing in front of the delivery unit 4 where he can reach the operation panel 22 extracts the printed sheet 11 as the sample for final printing from the delivery unit 4 after every predetermined number of printed sheets, and places it on the printed product checking table 27 of the operation panel 22.

The operator 30 visually compares the printed sheet 11 on the printed product checking table 27 with the printed sample. As the result of comparison, if the printed sheet 11 and the printed sample are different, the operator 30 operates the touch panel of the display 25 and the pushbuttons of the operation units 26*a* and 26*b* to adjust the inking amount, dampening, and registration in the circumferential and lateral directions.

If maintenance and inspection of the controller 29 in the case 21 are necessary, the operator pivots the operation panel 22 backward, as shown in FIG. 2A. Thus, the opening 21*a* of the case 21 is opened, and maintenance and inspection of the controller 29 are performed.

According to this embodiment, since the operation panel 22 is provided on the delivery unit 4, the operator 30 can extract the printed sheet 11 from the delivery unit 4 without moving. Thus, the extracting operation can be facilitated within a short period of time, thus improving the workability.

Since the operation panel 22 is inclined such that its height increases from the front side toward the rear side, the operator 30 can be located in front of the delivery unit 4 to perform operation including operating the operation panel 22. The front side of the delivery unit 4 is usually an empty space where no constituent components of the sheet-fed rotary printing press are present. The printed sheet 11 is extracted from the delivery unit 4 to this empty space and the operator 30 who operates the operation panel 22 is located in this empty space, so that operation can be performed smoothly.

Since the printing quality control unit 20 is integrally provided to the delivery unit 4, no special place is required for installing the printing quality control unit 20, so that the manufacturing cost can be reduced. Also, a wiring cable for connecting the printing press 1 and printing quality control unit 20, which hinders the operation, becomes unnecessary.

Since the printed product checking table 27 for placing the printed sheet 11 thereon is formed on the operation panel 22, the operator need not operate the operation panel 22 while manually holding the sheet 11, thereby improving the operability.

Since the opening 21*a* of the case 21 can be opened by only pivoting the operation panel 22 backward, maintenance and inspection of the controller 29 can be performed easily.

In this embodiment, if the step 17 does not hinder the operation or can be omitted, the operation panel 22 may be inclined on the delivery unit 4 in a direction perpendicular to the convey direction of the sheet 11, and the operator 30 may perform operation beside the delivery unit 4.

The printing quality control unit 20 controls not only the inking devices but also the damping unit and registration unit. Alternatively, the printing quality control unit 20 may adjust only the ink feed rates of the inking devices. As the sheet-like objects, the sheets 11 are used in the above embodiment. Alternatively, the sheet-like objects may be vinyl chloride sheets or the like, and the present invention can be applied to various types of sheet-like objects.

As has been described above, according to the present invention, a control unit for adjusting the ink is formed integrally, or mechanically integrated, with the delivery unit of the printing press. Therefore, a special place for installing the control unit is not necessary, and the manufacturing cost can be reduced. Since the operator need not make a round trip between the delivery unit and control unit of the printing press, the workability is improved. Also, since the printed product checking table is provided on the operation panel, the operability is improved.

What is claimed is:

1. A sheet-fed rotary printing press comprising:

a feed unit for feeding sheet materials one by one;

a printing unit for printing on the sheet materials supplied from said feed unit;

a delivery unit for delivering the sheet materials printed by said printing unit, said delivery unit comprising delivery chains to extend between a front and rear sprockets; and an ink amount adjusting unit fixed to an upper surface of said delivery unit and provided above said delivery chains of said delivery unit, for adjusting an amount of ink to be used for printing on the sheet materials, wherein said ink amount adjusting unit comprises:

an operation panel;

a control unit controlling ink amount adjustment and a case storing said control unit and having an opening opened/closed by said operation panel, said operation panel to engage with said opening when closing and opening.

2. An apparatus according to claim 1, wherein said ink amount adjusting unit has an operation panel with a support portion for the printed sheet materials.

3. An apparatus according to claim 1, wherein said ink amount adjusting unit has an operation panel provided in an inclined state in one of a convey direction of the sheet materials and a direction perpendicular thereto, such that a rear end thereof is higher than a front end thereof.

4. A sheet-fed rotary printing press comprising:

a feed unit for feeding sheet materials one by one;

a printing unit for printing on the sheet materials supplied from said feed unit;

a delivery unit provided at a terminal end of a sheet convey path, for delivering the sheet materials printed by said printing unit;

a pile board provided below said delivery unit at the terminal end of the sheet convey path, for stacking thereon printed sheets from said delivery unit; and an ink amount adjusting unit fixed to an upper surface of said delivery unit which is provided above said pile board, for adjusting an amount of ink to be used for printing on the sheet materials, wherein said ink amount adjusting unit comprises:

an operation panel;

a control unit for controlling ink amount adjustment; and a case storing said control unit and having an opening opened/closed by said operation panel, said operation panel to engage with said opening when closing said opening.

5. An apparatus according to claim 4, wherein said ink amount adjusting unit has an operation panel with a support portion for the printed sheet materials.

6. An apparatus according to claim 4, wherein said ink amount adjusting unit has an operation panel provided in an inclined state in one of a convey direction of the sheet materials and a direction perpendicular thereto, such that a rear end thereof is higher than a front end thereof.

7. A sheet-fed rotary printing press comprising:

a feed unit for feeding sheet materials one by one;

a printing unit for printing on the sheet materials supplied from said feed unit;

a delivery unit for delivering the sheet materials printed by said printing unit;

an ink amount adjusting unit fixed to an upper surface of said delivery unit, said ink amount adjusting unit to adjust an amount of ink to be used for printing on the sheet materials;

wherein said ink amount adjusting unit has an operation panel provided in an inclined state in one of a convey direction of the sheet materials and a direction perpendicular thereto, such that a rear end thereof is higher than a front end thereof;

wherein said ink amount adjusting unit further comprises (1) a control unit for controlling ink amount adjustment, and (2) a case storing said control unit and having an inclined opening opened/closed by said operation panel, said operation panel to engage with said opening in an inclined state when closing said opening; and a support member for supporting side ends of said operation panel such that said operation panel is pivotable, said opening to open when said operation panel is pivoted toward a rear side of said opening.

* * * * *